United States Patent [19]

Botrie

[11] Patent Number: 4,676,657

[45] Date of Patent: Jun. 30, 1987

[54] CARTRIDGE FOR THE DISPENSING OF TWO COMPONENT SYSTEMS FROM CAULKING GUNS

[76] Inventor: Alexander Botrie, 160 Balmoral Avenue, Suite 306, Toronto, Ontario, Canada, M4V 1J6

[21] Appl. No.: 781,995

[22] Filed: Sep. 30, 1985

[51] Int. Cl.[4] ..... B01F 15/02

[52] U.S. Cl. ..... 366/177; 222/94; 222/136; 222/145; 366/339

[58] Field of Search ..... 366/177, 130, 184, 186, 366/190, 182, 189, 336–340; 222/88, 94, 136, 137, 145, 386

[56] References Cited

U.S. PATENT DOCUMENTS

| | | | |
|---|---|---|---|
| 3,227,319 | 1/1966 | Rosier | 222/94 |
| 3,286,992 | 11/1966 | Armeniades et al. | 366/339 |
| 3,806,097 | 4/1974 | Devellian et al. | 366/339 |
| 4,271,984 | 6/1981 | Ducros et al. | 222/94 |
| 4,340,154 | 7/1982 | VanManen | 222/94 |
| 4,538,920 | 9/1975 | Drake | 366/177 |

OTHER PUBLICATIONS

'Semkit' brochure, S-102, dated Feb. 1, 1975.

*Primary Examiner*—Timothy F. Simone
*Attorney, Agent, or Firm*—Ridout & Maybee

[57] ABSTRACT

A cartridge assembly for a caulking gun or similar dispenser contains two or more components to be mixed upon operation of the gun. One component is stored within an inner tubular container with flexible walls, which walls are sustained against collapse by a light gauge spiral spring extending between the nozzle end and the plunger end of the cartridge. The cartridge may have a rigid cylindrical outer tube within which the second component is retained by a plunger, or a flexible tubular outer container for the second component, again supported against collapse by a spring. A passive mixer unit is provided at the nozzle end of the assembly either inside or outside the body. The mixer unit is preferably cylindrical, defining internally a double spiral mixing passage containing passive mixer elements.

29 Claims, 9 Drawing Figures

CARTRIDGE FOR THE DISPENSING OF TWO COMPONENT SYSTEMS FROM CAULKING GUNS

This invention relates to the dispensing of materials formed from components which cannot be mixed until immediately prior to use. Typical examples of such materials are epoxy resin compositions which are mixed when used with a hardener component which causes subsequent curing of the resin.

Viscous materials such as caulks and adhesives are commonly dispensed from disposable cartridges of standard configuration and standard sizes used in conjunction with caulking guns which are designed to accept such cartridges. The cartridges comprise a tubular cylindrical body containing material to be dispensed, a movable plunger at one end of the body retaining the material within the body and providing the means for a caulking gun to apply dispensing pressure to the contents of the cartridges, and an integral or detachable dispensing nozzle at the other end of the body. Such cartridges in their usual form are suitable only for dispensing single component or ready mixed materials.

There is a need for two component materials packed in cartridges usable in conventional caulking guns. Desirably, the cartridges should be of sufficiently inexpensive construction to be disposable, should ensure accurate proportioning of the components throughout dispensing, and should thoroughly mix the components before they reach the nozzle.

U.S. Pat. No. 3,323,682 issued June 1967 to Creighton et al discloses a disposable cartridge for use in conventional caulking guns and providing for separate storage of the components of a multiple component system. The components are packed in separate collapsible tubes within the cartridge, each having its own independent nozzle. No provision is made for mixing the components prior to dispensing, and it is believed that accurate proportioning of the ingredients would not be achieved except where components of similar viscosity are dispensed through identical nozzles. With dissimilar nozzles or viscosities it is likely that one component would initially be dispensed preferentially to the other. This problem would be aggravated were any kind of mixing means to be incorporated in the device.

U.S. Pat. No. 4,340,154, issued July 20, 1982 to VanManen, discloses a cartridge which incorporates a passive mixer in a dispensing nozzle, and which should maintain substantially accurate proportioning of the components of a two component system. This is achieved by storing a first component within an accordion pleated container secured between the plunger and the nozzle, surrounded by the second component within the main cylinder. As the plunger is moved down the tube, the accordion pleated inner container is progressively reduced in length, but maintains a substantially constant mean cross section, thus providing accurate proportioning of the components. The first component may be stored either directly within the pleated container, or in a collapsible tube housed within the container. Whilst the arrangement appears functionally very satisfactory, the necessity for the accordion pleated container renders it less attractive from a manufacturing point of view. The container requires an expensive mould, and a different size is required for each different proportion of the two components. It must be attached to other components at both ends, thus complicating both the structure and its assembly, and it will not collapse beyond a certain minimum length, thus reducing the effective capacity of the cartridge and wasting material which cannot be dispensed. Although the provision of a mixer in the dispensing nozzle is noted, the structure of this mixer is not disclosed. It is often very important that very thorough mixing of two component systems is achieved prior to use, and the present applicant doubts that a passive mixer of sufficient performance can be accommodated within the narrow confines of a dispensing nozzle.

An available product sold by Semco under the trade mark SEMKIT has two components stored separately within a cartridge. When the cartridge is to be used, one component is injected into the other within the cartridge, or a barrier within the cartridge is ruptured, and the contents of the cartridge are mixed using a mixing rod extending through what later becomes an attachment for a nozzle. The product requires a considerable amount of manipulation before it can be used (indeed machines are available to carry out the mixing step) and the entire contents of the cartridge are mixed at the same time, thus not only requiring that the entire contents of the cartridge be used in one session, but that dispensing be completed within the setting time of the mixed material.

Although many other proposals have been made for the dispensing of two component systems, particularly from collapsible or parallel tubes, those discussed above are the only ones known to the applicant which appear really practicable for use in disposable cartridges for standard caulking guns.

It is among the objects of the present invention to provide a disposable cartridge for two component systems which can be manufactured economically, which can maintain accurate proportions of the components during use, and which can provide efficient mixing of the components prior to dispensing.

The invention relates to a cartridge assembly, for use in a caulking gun, comprising a tubular cylindrical body, exit nozzle means at one end of the cylinder, the opposite end of the body being engageable by a plunger movable within the gun to expel contents of the body through the exit nozzle means, a tubular collapsible container storing a first component of a two component mix and extending between said nozzle means and said opposite end, and a second component within the body surrounding the collapsible container. The invention provides the improvement wherein the walls of the tubular collapsible container have no significant stiffness in any dimension, and are sustained against both longitudinal and radial collapse by a coil compression spring wound from light gauge wire and having a free length at least equal to the distance between the initial position of the plunger and the exit nozzle means and an outside diameter equal to a diameter of the collapsible container to be maintained during dispensing. Preferably the exit nozzle means includes passive mixing or combining means for the components.

According to further features of the invention, a passive mixer for multiple component systems dispensed from separate compartments in a dispenser comprises a mixer body defining an inlet and an outlet for fluid materials, an elongated labyrinthine passageway of much greater length than any external dimension of the body, and an elongated mixer element or elements fixed within the passageway and formed by material of sufficient rigidity to resist displacement by fluids passing through the passageway. In one form the body comprises at least two stacked discs, and the labyrinthine passageway is formed by complementary grooves formed in the adjacent faces of the discs.

The mixer body is preferably cylindrical and of similar diameter to the cartridge body, and may either be placed within the one end of the body during assembly, or be attached externally to the end of the body prior to use.

Further features of the invention will become apparent from the following description of preferred embodiments thereof with reference to the accompanying drawings.

IN THE DRAWINGS

FIG. 1 is a longitudinal section through a first type of cartridge embodying the invention;

FIG. 2. is a corresponding fragmentary view on an enlarged scale of portions of the cartridge;

Figure 1:
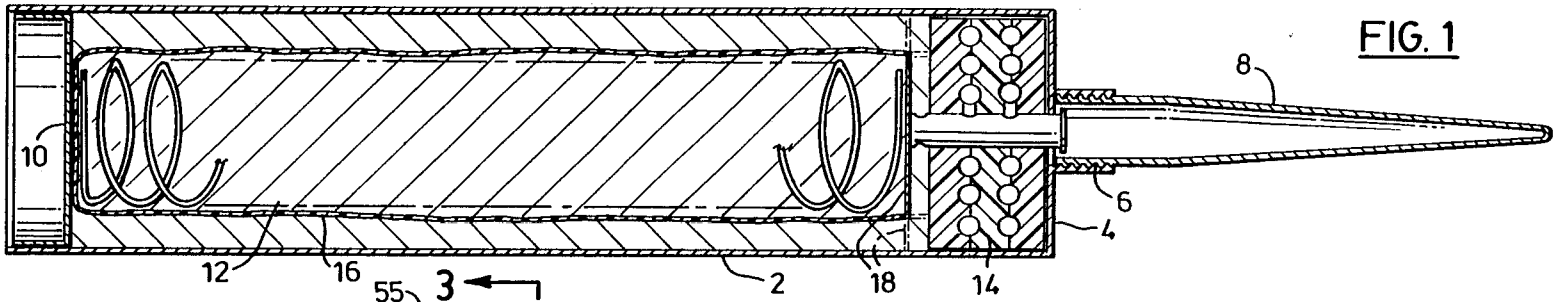

Referring to FIG. 1, a disposable cartridge for a caulking gun has a conventional rigid tubular cylindrical body 2, with an end cap 4 at one end. The body 2 and cap 4 may be of conventional construction, with the body being formed of metal, cardboard or plastic, and the cap of metal or moulded from plastic integrally with the body.

The end cap has a threaded coupling 6 to receive a screwin nozzle 8. The other end of the body is provided with a conventional cup shaped plunger 10 of metal or plastic, which is moved by the push rod of a caulking gun from an initial position towards the nozzle 8 to expel material from the body 2. Thus far all the components described are conventional in the art, and require no special modification.

In order to adapt the cartridge for use with two component systems, certain additional structure is housed within the body 2, essentially consisting of a collapsible container 12 for a first of the components and a mixer unit 14 for mixing the two components. The container 12 is formed by a cylindrical tube 16 of thin flexible film, such as synthetic plastic film resistant to both components of the mixture to be dispensed. The tube is filled with the first component and closed at both ends, one end being bonded to a locating and porting member 18. The member 18 (see FIG. 2) has a disc portion bonded to the tube, a porting tube 20 extending from the disc through a central aperture in the mixer unit 14, and positioning legs 22 and 24 which locate the disc against radial movement by engaging the body 2 and axial movement towards the nozzle by engaging the mixer unit. A rupturable seal 26 is formed at the entrance to the porting tube 20, either by the film of the tube or by a separate membrane of, for example, aluminum foil.

Also sealed within the tube 16 is a light gauge compression coil spring 28, having a free length at least equal to the distance between the plunger 10 and the nozzle assembly at the other end of the cartridge, this being considered to begin with the member 18. The spring has a diameter substantially the same as that of the tube 16, and acts both to support the walls of the tube against radial collapse, and to hold the tube against the plunger 10.

A tubular valve member 30 is a sliding fit within the porting tube 20, and in a normal, storage position has ports 32, 34 and 36 which are axially outwardly displaced from ports 38, 40 and 42 in the porting tube 20. The valve member is divided into two separate passages by a diaphragm 44, and is formed with teeth 46 at its inner end adjacent the seal 26.

The mixer unit 14 has a body formed by three discs 48, 50, 52. The discs 48 and 52 are identical, and are formed on one side with a spiral groove 51 of semicircular cross-section. The disc 50 has complementary opposite handed grooves 51 formed on both sides and connected at their outer ends by a port 54. When the discs are stacked and keyed or bonded together, they define a double spiral passage extending outwardly from the port 38, through the port 54 and back to the port 42. Trapped within the spiral passage are passive mixer elements 55, which may be formed in various arrays. Thus elongated mixer elements formed of plastic or metal having sufficient rigidity to resist displacement by the material passing through the passage may be utilized, such as those sold under the trademark "STATIC MIXER" by Kenics Corporation, and described in U.S. Pat. No. 3,286,992, or mixing blades may be moulded into the walls of the passages defined by the discs. The actual structure utilized will depend upon the viscosity of the materials being mixed, since it is necessary to reduce obstructions in the passages to a degree which will permit material to be dispensed at a desired rate without the development of excessive back pressure in the cartridge.

The arrangement described is quite simple to manufacture. The mixer unit 14 is assembled from its component discs with the mixing elements, if separate, captive between them, and is slipped over the porting tube 20 of a filled container 12. The valve member 30 is inserted into the porting tube 20 so that the teeth 46 are short of the seal 26, and the assembly is inserted into the tubular body 2 so that the end of the valve member 30 projects into the coupling 6. The space between the container 12 and the tube 2 is filled with a second component material, and the plunger 10 is inserted to close the open end of the tube.

In use, the cartridge is loaded into a conventional caulking gun, and a nozzle 8 is screwed into the coupling 6. The inward end of the nozzle engages a flange at the outer end of the valve member 30, forcing the latter inwards so that the teeth 46 rupture the seal 26 and the ports, 32, 34 and 36 align with the ports 38, 40 and 42. When pressure is applied to the plunger 10 by the gun, the first component from the inner container 12 is expelled into the valve member 30 past the ruptured seal 26, whilst the second component between the container and the tube is forced past the positioning legs of the member 18 and through the ports 32 and 38 into the the valve member 30 where it mixes with the first component. The mixture then leaves the valve member 30 through the ports 34 and 40 and enters the mixer unit 14, within which it passes through the double spiral passage and is thoroughly blended by the mixer elements with the inwardly and outwardly spiral portions of the passage. The blended material re-enters the valve member 30 through the ports 42 and 36 and is expelled through the nozzle 8.

With this arrangement, it is necessary to use the entire contents of the cartridge at one time, or to discard the remainder, at least in the case of materials which harden after mixing, since the mixed material in the mixer unit will set if allowed to remain therein, thus ruining the mixer and blocking access to the remainder of the nozzle assembly. FIG. 4 shows an alternative embodiment which permits the contents of the cartridge to be used over an extended period. This embodiment is generally similar to that of FIGS. 1–3, except that the mixing unit 114 is a separate external unit which screws onto a coupling 106 on the end of the body 2 and provides a coupling 206 for the nozzle 8. The port 20 is replaced by an unported tube 120, which merely provides access to the seal 26 (if present), a removable seal 122 being provided to close both the tube 120 and the remaining cross section of the nozzle 106. This seal, and a removable screw cap (not shown) close off the concentric passageways for the two components formed by the nozzle 106 and the tube 120, thus providing for saving an unused portion of the contents of the cartridge by removing the unit 114 and replacing the cap. The unit 114 is replaced by an unused unit 114 before further use of the cartridge. The functions of the portions of the porting and valve tubes within the unit 114 are provided by coaxial passages 156 and 158 through the discs 148 and 152.

Figure 3:
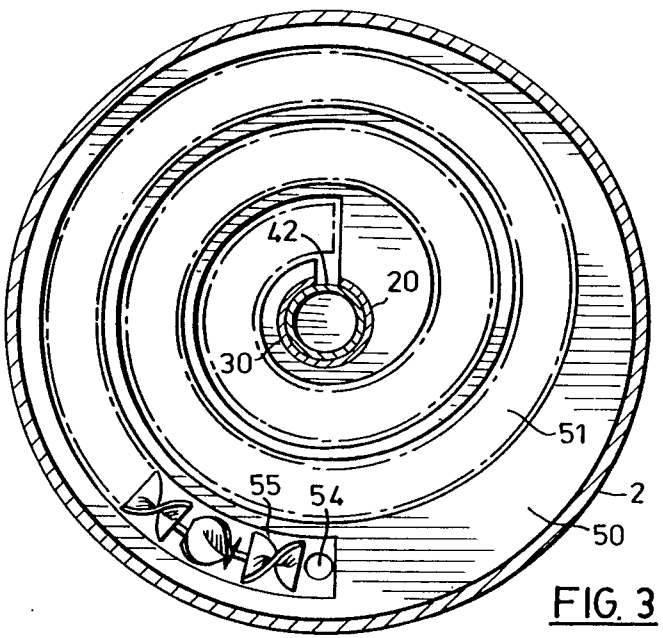
FIG. 3 is a transverse section on the line 3—3 in FIG. 2.
Figure 2:
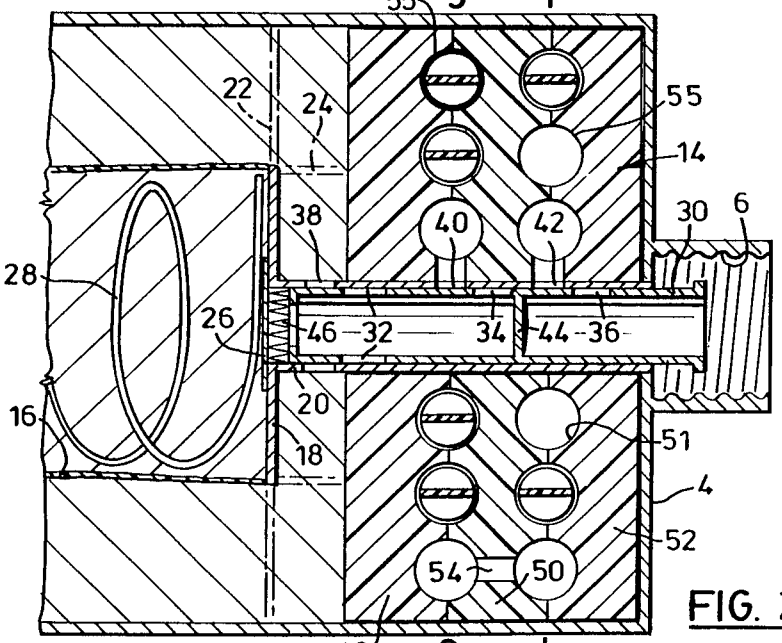
Figure 4:
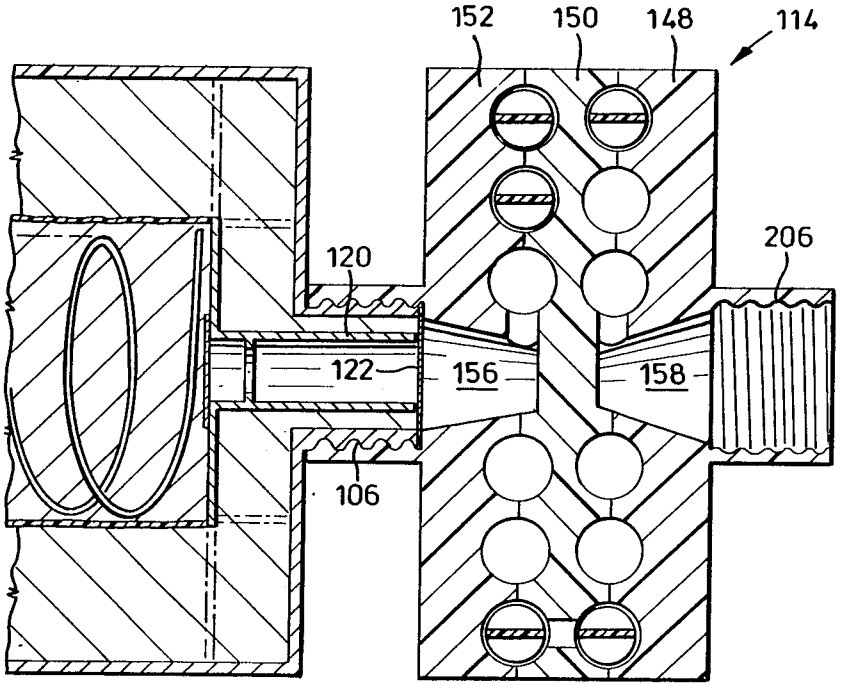
FIG. 4 is a view similar to that of FIG. 2, showing details of a second type of cartridge.
Figure 5:
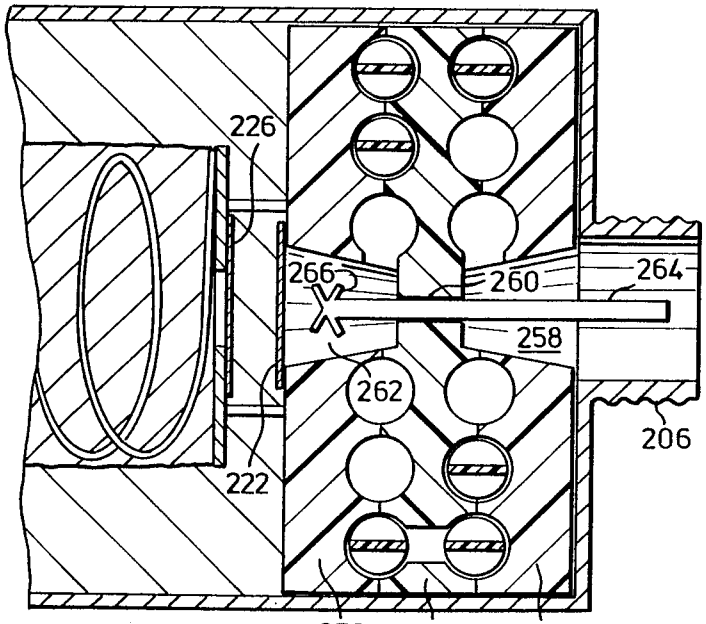
FIG. 5 is a view similar to that of FIG. 2, showing details of a third embodiment of cartridge.

FIG. 5 illustrates a modification of the embodiment of FIGS. 1–3 in which the porting tube 20 and valve member 30 are dispensed with, and a central bore 260 in the element 250 is much reduced in diameter (parts corresponding to parts in the other Figures are given the same reference numerals with the addition of 200). In order to maintain the components separate and sealed, the seal 226 is supplemented by a seal 222 at the entrance of a central bore 262 in the element 252. In order to break the seals, which may be of plastic or metal foil, when it is desired to use the unit, a plunger 264 is provided which is a sliding fit in the bore 260 and has an outward portion extending through a central bore 258 in the element 248 into the coupling 206. At the inner end of the plunger are fingers 266 which rupture the seals when the outward portion of the plunger 264 is pressed inwardly. A nozzle can then be screwed onto the coupling 206 prior to dispensing of the contents of the cartridge, duly mixed on passing through the spiral passage in the mixer unit. The plunger 264 is retained in a position blocking the bore 260 by the fingers 266.

Figure 6:
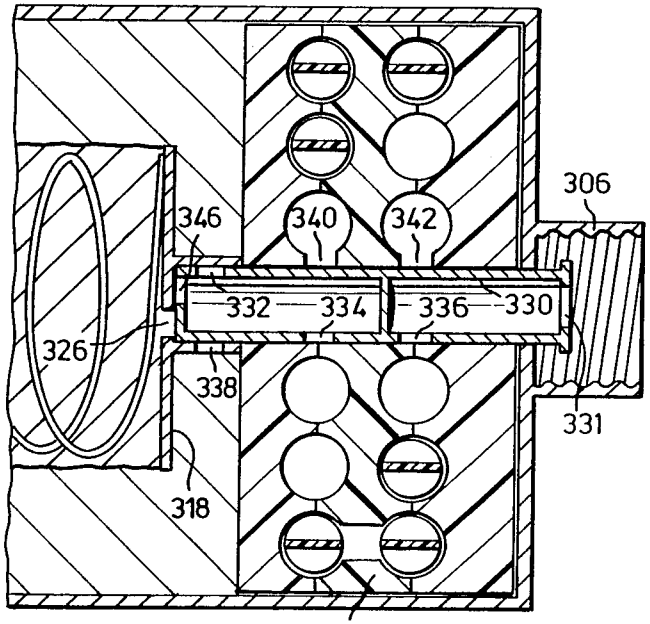
FIG. 6 is a view similar to that of FIG. 2 showing details of a fourth embodiment of cartridge.

An alternative valve member 330 is incorporated in the embodiment of FIG. 6. As compared with FIG. 2, the seal 26 and teeth 46 are dispensed with, the seal being replaced by a portion of the member 218 which has an offset aperture 326. Instead of the valve member 330 being axially movable, it is rotatable by means of a screwdriver or other suitable tool inserted in an opening 331 at its outer end so as to align ports 332, 334 and 336 with ports 338, 340 and 342, and an axially offset port 346 with the aperture 326, thus placing both components in communication with the mixer 314 and the mixer in communication with the coupling 306, as in the FIG. 2 embodiment.

Figure 7:
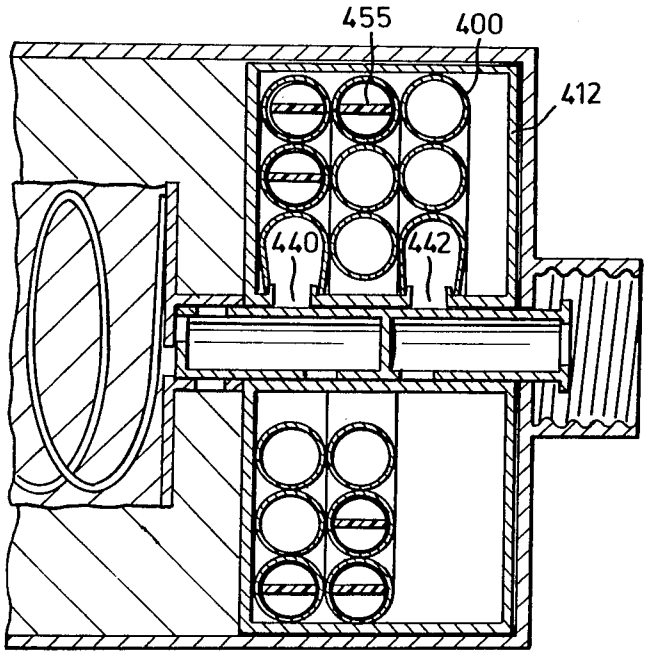
FIG. 7 is a view similar to that of FIG. 2, showing details of a fifth embodiment of cartridge.

The labyrinthine passage of the mixer unit may be formed by alternative means. For example as shown in FIG. 7, the longitudinally extending mixer element or elements 455 may be inserted in an elongated flexible tube 400 moulded for example from a synthetic plastic such as polyethylene which is coiled or otherwise compactly arranged within a mixer housing 412. Where such an arrangement is utilized internally of the cartridge analogously to the embodiment of FIG. 1–3, the tube may extend between the ports 440 and 442 in place of the passages defined by the units 48, 50 and 52 of FIGS. 1–3.

Figure 8:
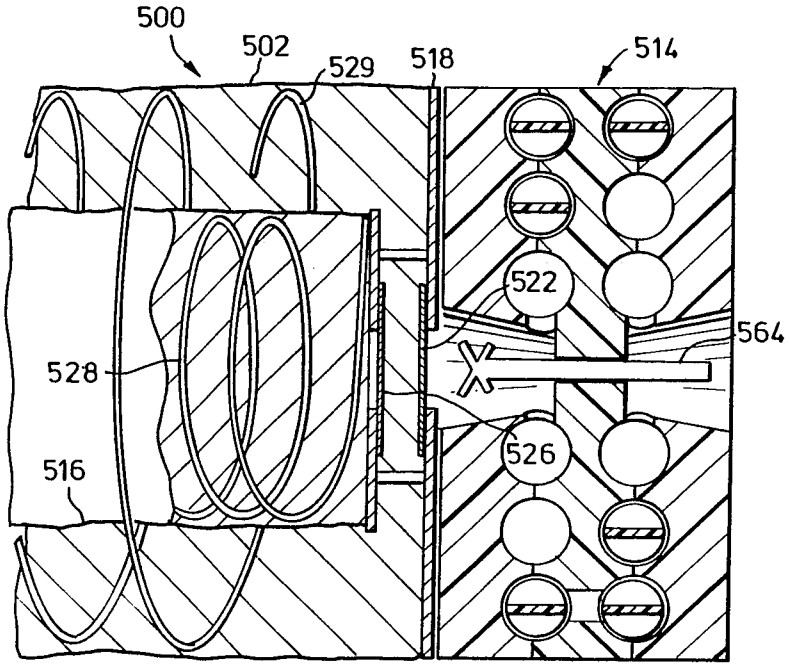
FIG. 8 is a longitudinal section through a sixth embodiment of cartridge in which the tubular cylindrical body is also formed by a tubular collapsible container.

In some applications, particularly using large, fully enclosed caulking guns, it is preferred to use cartridges, or "sausages" in which the conventional rigid body is replaced by a flexible tubular bag containing the material to be dispensed, the remaining functions of the body being provided by the gun itself. An embodiment of the invention adapted to this concept is illustrated in FIG. 8. The body 2 is replaced by a flexible cylindrical tube 502, of similar construction to an inner bag 516 which in turn is similar to those used in the embodiments previously described. In order to maintain proper proportioning of the components, it will usually be desirable to support the outer bag by a light spring 529 in the same manner as the inner bag is supported by spring 528. The bags are provided with closure seals 522 and 526 similar to the seals 222 and 226 of FIG. 5. A mixer unit 514, of similar construction to that described with reference to FIG. 5 is attached in front of the locating member 518 or placed in the caulking gun in front of the sausage 500. The plunger 564 is then used to break the seals as in the embodiment of FIG. 5.

Figure 9:
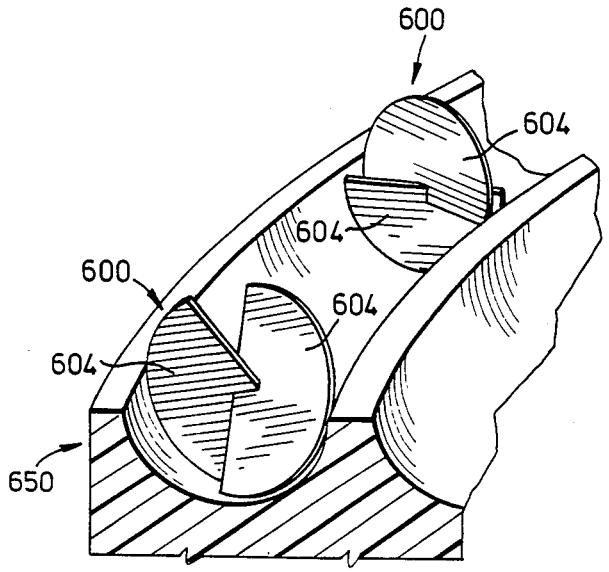
FIG. 9 illustrates an alternative form of passive mixer element which may be utilized in the various embodiments of mixer unit.

FIG. 9 illustrates an alternative form of passive mixer element. Each element 600 is formed by a disc of metal or synthetic plastic, which has been slit from diametrically opposed points on its periphery to spaced points close to its centre, so that opposite halves 604, 604 of the disc may be twisted relative to one another to produce mixer elements as shown in the Figure. Similar elements may be moulded integrally with a mixer element 650 rather than being formed separately.

Whilst the above described embodiments each contemplate the dispensing of a product made up of two components stored concentrically, it will be appreciated that the principles of the invention may be utilized with products made up of more than two components, and these need not necessarily be stored coaxially, provided that provision can be made for breaking any necessary seals before use of the cartridge.

I claim:

1. A cartridge assembly for use in a caulking gun and comprising a tubular cylindrical body having opposite ends exit nozzle means at one opposite end of the body, and end wall at the other opposite end of the body engageable by a plunger movable within the gun to expel contents of the body through said exit nozzle means, an inner collapsible container storing a first component of a two component mix and extending longitudinally of the body, and a second component within the body surrounding the collapsible container, wherein the inner collapsible container is of tubular cylindrical form with walls of thin flexible film, and a coil compression spring of light gauge wire and tubular cylindrical form resides within the collapsible container, said spring having a diameter substantially equal to that of the container and free length greater than the distance from said exit nozzle means to said opposite end, whereby to support said container and press it towards said opposite ends, and rigid means are provided defining an opening from said container, said rigid means supporting the end of the container spaced from said exit nozzle and from the end of said body over the full diameter of the container to define a combining zone for said first and second components and said rigid means also sustaining the reaction from said container as its contents are extruded through said opening into said combining zone.

2. An assembly as claimed in claim 1, wherein said combining zone contains a passive mixer for combining the components.

3. An assembly as claimed in claim 2, wherein the passive mixer comprises a mixer body defining an inlet and an outlet for fluid materials, an elongated labyrinthine passageway of much greater length than any external dimension of the body, and an elongated mixer element or elements fixed within the passageway and formed by material of sufficient rigidity to resist displacement by fluids passing through the passageway.

4. An assembly as claimed in claim 3, wherein the body comprises at least two stacked discs, and the labyrinthine passageway is formed by complementary grooves formed in the adjacent faces of the discs.

5. A cartridge assembly according to claim 4, wherein the passing mixer elements are moulded integrally with the discs.

6. An assembly as claimed in claim 3, wherein the mixer body is cylindrical and of similar diameter to the cylindrical body of the cartridge.

7. A cartridge assembly according to claim 6, wherein the mixer body has an axial entrance and an axial outlet to said exit nozzle, said passive mixer further defining an axial passage between said axial entrance and said axial outlet, and actuator means having an outer end accessible from said exit nozzle, said mixer unit further defining an axial passage between said axial entrance and said axial actuator means having an outer end accessible from said nozzle, a central portion passing through said axial passage and blocking passage of the components therethrough, an inner end movable by manipulation of said outer end to disable obstructions blocking extrusion of said components into said axial entrance.

8. An assembly as claimed in claim 3, wherein the mixer is attached externally to the one end of the body.

9. An assembly as claimed in claim 3, wherein the mixer is housed within the body at said one end.

10. An assembly as claimed in claim 3, wherein the labyrinthine passageway is formed by a flexible tube coiled within the mixer.

11. An assembly according to claim 1, wherein the tubular cylindrical body of the cartridge is a rigid cylindrical tube having an end plate at one end supporting the exit nozzle means and a piston element axially movable within the body and forming the opposite end wall of the latter.

12. An assembly according to claim 1 wherein the tubular cylindrical body of the cartridge is a second tubular collapsible container having flexible walls surrounding the first tubular collapsbible container and containing the second component.

13. An assembly according to claim 12, further comprising a second coil compression spring wound from light gauge wire, said spring sustaining from within the walls of the second tubular container against radial and longitudinal collapse and having a free length at least equal to the distance between the opposite end wall of the body and the exit nozzle means.

14. An assembly as claimed in claim 3, including closure means between each of the components and the passive mixer.

15. An assembly according to claim 14, wherein the closure means are frangible seals.

16. An assembly according to claim 15, further including a plunger extending through the passive mixer and axially movable to fracture the seals.

17. An assembly according to claim 14, wherein the closure means comprises a valve member movable in said combining zone between a position blocking passage between said component and said mixer, and a position permitting said passage.

18. An assembly according to claim 17, wherein the valve member is axially movable between said positions.

19. An assembly according to claim 17, wherein the valve member is rotatable between said positions.

20. A cartridge assembly for use in caulking guns, comprising a cylindrical body having plural longitudinally extending conjointly collapsible compartments for different fluid components of a multiple component mix, said body being engageable at one end by a plunger to expel the different components in predetermined proportions from a nozzle at the other end of the body, the improvement wherein said other end of the body is a cylindrical passive mixer unit, said mixer unit having an axial entrance at an inner end for receiving said components, and an axial exit to said nozzle at an outer end, an extended convoluted passage being defined within the mixer unit extending between the axial entrance and the axial nozzle, containing a pluality of longitudinally distributed passive mixer elements, said mixer unit further defining an axial passage between said axial entrance and said axial actuator means having an outer end accessible from said nozzle, a central portion passing through said axial passage and blocking passage of the components therethrough, and an inner end movable by manipulation of aid outer end to disable obstructions blocking extrusion of said components into said axial entrance.

21. A cartridge assembly according to claim 20, wherein said obstructions comprise a first valve member formed by the actuator means.

22. A cartridge assembly according to claim 21, wherein the valve member is an axially movable sleeve valve.

23. A cartridge assembly according to claim 21, wherein the valve member is a rotary sleeve valve.

24. A cartridge assembly according to claim 21, wherein the actuator member also forms a second valve member, operable conjointly with the first valve member, and operable to permit mix to pass from said mixer to said nozzle.

25. A cartridge assembly according to claim 20, wherein said obstructions comprise at least one seal trangible by manipulation of the actuator means.

26. A cartridge assembly according to claim 20, wherein the passive mixer elements are moulded integrally with the discs.

27. In a cartridge assembly for use in caulking guns, comprising a cylindrical body having plural longitudinally extending conjointly collapsible compartments for different fluid components of a multiple component mix, said body being engageable at one end and by a plunger to expel the different components in predetermined proportions from a nozzle at the other end of the body, the improvement wherein said other end of the body is a cylindrical passive mixer unit, said mixer unit having an axial entrance at an inner end for receiving said components, and an axial exit to said nozzle at an outer end, an extended convoluted passage being defined within the mixer unit extending between the axial entrance and the axial nozzle, and containing a plurality of longitudinally distributed passive mixer elements.

28. An assembly according to claim 27, wherein the mixer unit comprises a plurality of stacked cylindrical discs, the convoluted passage being defined by grooves formed in the adjacent surface of the discs.

29. A cartridge assembly according to claim 28, wherein the passive mixer elements are moulded integrally with the discs.

* * * * *